US008628343B2

(12) United States Patent
Sasaki et al.

(10) Patent No.: US 8,628,343 B2
(45) Date of Patent: Jan. 14, 2014

(54) CONNECTOR

(75) Inventors: Daisuke Sasaki, Yao (JP); Takayuki Nagata, Yao (JP)

(73) Assignee: Hosiden Corporation, Osaka (JP)

( * ) Notice: Subject to any disclaimer, the term of this patent is extended or adjusted under 35 U.S.C. 154(b) by 22 days.

(21) Appl. No.: 13/397,873

(22) Filed: Feb. 16, 2012

(65) Prior Publication Data

US 2012/0258618 A1 Oct. 11, 2012

(30) Foreign Application Priority Data

Apr. 8, 2011 (JP) ..... 2011-086578

(51) Int. Cl.
*H01R 13/62* (2006.01)

(52) U.S. Cl.
USPC ..... 439/260

(58) Field of Classification Search
USPC ..... 439/260, 497, 495, 312, 329
See application file for complete search history.

(56) References Cited

U.S. PATENT DOCUMENTS 7,422,472 B2 * 9/2008 Hashiguchi et al. ..... 439/495
8,025,516 B2 9/2011 Yokoo et al.
2002/0115340 A1 * 8/2002 Yamane ..... 439/495
2008/0050958 A1 * 2/2008 Hashiguchi et al. ..... 439/312
2010/0130045 A1 * 5/2010 Higuchi ..... 439/260
2010/0255705 A1 * 10/2010 Higuchi ..... 439/329
2010/0304594 A1 12/2010 Yokoo et al.
2012/0045930 A1 * 2/2012 Ueda et al. ..... 439/497

FOREIGN PATENT DOCUMENTS

JP 2005196995 A 7/2005
JP 2010282765 A 12/2010
WO 2009069107 A2 6/2009

* cited by examiner

*Primary Examiner* — Alexander Gilman
(74) *Attorney, Agent, or Firm* — The Webb Law Firm

(57) ABSTRACT

A connector includes: a contact portion electrically connectable to a plate-shaped connection object; a housing having a slit-shaped opening into which the connection object is insertable, the housing accommodating the contact portion; an actuator which is supported on the housing swingably about an axis extending in a width direction of the opening, and configured to directly press the connection object; and a restricting mechanism which is provided along the width direction of the opening, formed in both the housing and the actuator, and configured to prevent the actuator from being deformed in a direction opposite to a pressing direction of the actuator when the actuator is in a posture of pressing the connection object.

6 Claims, 6 Drawing Sheets

CONNECTOR

FIELD OF THE INVENTION

The present invention relates to a connector including: a slit-shaped opening into which a plate-shaped connection object is insertable; a contact portion electrically connectable to the connection object; a housing for accommodating the contact portion; and an actuator for directly pressing the connection object, which actuator is supported on the housing swingably about an axis extending in a width direction of the opening.

DESCRIPTION OF THE RELATED ART

As a conventional connector, there can be mentioned, for example, a connector disclosed in Japanese Unexamined Patent Application Publication No. 2005-196995. In this connector, when a connection object is inserted into an opening of a housing and an actuator is closed for electrically connecting the connection object to a circuit board, the connection object is pinched between the actuator and the housing with a contact portion accommodated in the housing.

In the typical connector, in order to prevent EMI (electromagnetic interference), a metal cover is attached to cover the housing. In the connector described in the above-described Japanese Unexamined Patent Application Publication No. 2005-196995, the metal cover is also utilized for enhancing a pressing effect of the actuator. Specifically, by engaging a plurality of engaging holes formed in the metal cover with projections formed in the actuator, especially when the actuator is put into a closed posture, the actuator is prevented from being detached from the connector, while the actuator is supported to press the connection object.

However, in the above-described connector, as will be described below, there may be some cases in which the actuator cannot necessarily reliably press the contact portion.

For example, the metal cover is typically obtained by punching a plurality of the engaging holes in a metal plate and bending certain portions of the metal plate. The engaging holes are engaged with the protrusions provided in the housing. However, such a sheet-metal processing generally causes errors to some extent. Therefore, when the metal cover is attached to the housing, the positions of the actuator and the metal cover are not necessarily set to their expected positions. In this case, when the actuator is operated into the closed posture, for example, the metal cover may have regions which do not come into contact with the actuator. Because the metal cover in such a region cannot fully support the actuator to press, the connection at the contact portion may become poor.

In addition, since the metal cover is obtained by bending a plate-like member, the metal cover is relatively easily bent and deformed by an external force acting in an off-plate direction. A width of the actuator extends to a whole width of the opening into which the connection object is to be inserted. Therefore, when the actuator is in the closed posture and the metal cover is pressed by the actuator on which a press reaction force from the contact portion is acted, the metal cover is likely to be deformed since a span of the support for the metal cover is long. In this case also, the connection at the contact portion may become poor.

Further, inconveniences may arise due to conditions of a manufacturing process of the connector. For example, for fixing a surface-mounted component, such as connector, to a substrate, a reflow method has been typically used. In this method, the connector is mounted on the substrate on which cream solder has been printed, and the substrate is heated using a reflow furnace, to thereby melt the cream solder and solder the connector to the substrate.

With this heating, the metal cover, the actuator and the like are thermally expanded. In this case, due to difference in coefficient of thermal expansion or attachment conditions between these components, a residual strain may be generated in any of these components after heating, or a misalignment may occur in the positions of these components. This tendency becomes notable when lead free solder having a high melting point is used. When such a deformation occurs, pressing function of the actuator may be lost.

As described above, in the conventional connector, in order to secure the pressing function of the actuator, the metal cover is used in addition to the housing and the actuator, and thus the pressing accuracy of the actuator was not enough. In a case where such a metal cover is desired to exert a reliable pressing function, it is necessary to make, for example, a thickness of the plate larger, for suppressing the deformation of the metal cover or the like. However, in that case, the bending of the metal plate becomes difficult, leading to increase in material cost and processing cost. In this manner, with the conventional connector, various problems exist and there has been a room for improvement in obtaining a reasonable connector.

Therefore, it is desirable to provide a reasonable connector that can reliably exert the function of connecting with the connection object.

SUMMARY OF THE INVENTION

The connector of the present invention includes a contact portion electrically connectable to a plate-shaped connection object; a housing having a slit-shaped opening into which the connection object is insertable, the housing accommodating the contact portion; an actuator which is supported on the housing swingably about an axis extending in a width direction of the opening, and configured to directly press the connection object; and a restricting mechanism which is provided along the width direction of the opening, formed in both the housing and the actuator, and configured to prevent the actuator from being deformed in a direction opposite to a pressing direction of the actuator when the actuator is in a pressing posture of pressing the connection object.

With this configuration, the housing is provided with the restricting mechanism for preventing the actuator from being deformed in the direction opposite to the pressing direction, and thus especially when the actuator is in a closed state, rising of the actuator can be reliably prevented. In addition, since the housing and the actuator are often produced by injection molding of resin or the like, these are shaped with very high accuracy, and from this viewpoint, relative position of the actuator to the housing becomes accurate, leading to more reliable prevention of rising of the actuator by the restricting mechanism.

In addition, with respect to the influence of heating by a reflow furnace, attention has to be paid only to a change in relative position between the actuator and the housing. In other words, unlike the prior art, the relative position is no longer determined by three members including the metal cover, and thus the relative position between the actuator and the housing is more stably retained.

As described above, with the present configuration, a connector can be more reasonably formed in which a contact pressure between the contact portion and the connection object is appropriately retained.

The restricting mechanism may, for example, include: a projection which projects from the housing and has a restricting face facing downward; and a recess which is formed in the actuator contiguously from an upper face to a front face of the actuator and has a restricted face configured to be brought into surface contact with the restricting face when the actuator is in the pressing posture.

The connector of the present invention may further include a metal cover for covering the housing, wherein the metal cover includes a pressing portion for pressing the inserted connection object when the actuator is in an opened posture.

With this configuration, by providing the pressing portion for pressing the connection object inserted into the opening, even before the actuator is set to a pressing posture, the connection object can be temporarily held. As a result, when the actuator is operated to close, the connection object will not be pinched at a position displaced from the proper position, and is prevented from being detached from the connector.

The pressing portion may be, for example, formed of a part of the metal cover, which part is bent in the pressing direction.

When the actuator is in the closed posture, the connection object has a portion pressed by an elastic force exerted by the pressing portion, and a portion pressed by the actuator. In other words, pressing force on the connection object may be partially different. In this case, the contract pressure between the contact portion and the connection object becomes partially different, which is not preferable.

Therefore, in the connector according to the present invention, the actuator may include an auxiliary pressing portion for enhancing a pressing force exerted by the pressing portion, by coming into contact with the pressing portion when the actuator is in the pressing posture.

With this configuration, by enhancing the pressing force exerted by the pressing portion using the auxiliary pressing portion, the pressing force exerted by the actuator and the pressing force exerted by the pressing portion can be set equivalent. Therefore, unevenness in the contact pressure between the contact portion and the connection object can be reduced.

The connector of the present invention may be configured so that the actuator has lateral end portions, each of which is provided with a shaft, the housing has lateral walls, each of which is provided with an approximately U-shaped shaft support for rotatably support the corresponding shaft, and the metal cover is configured to cover an opening part of the shaft support.

With this configuration, by simply fitting the shaft into the shaft support and attaching the metal cover, the shaft is prevented from being detached from the shaft support due to the presence of the metal cover. In addition, the shaft support can be obtained by a simple processing to form a cutout in an approximate U-shape in the housing, and thus a production cost can be suppressed.

The connector of the present invention may be configured in such a manner that the connection object has lateral end portions in a width direction thereof, each of which lateral end portion is provided with an absent portion formed therein, and the housing is provided with a protrusion formed on a bottom side of a space in communication with the opening, the protrusion being engageable with the absent portion when the actuator is in the pressing posture.

With this configuration, by engaging the protrusion of the housing with the absent portion of the connection object while the actuator is in a closed state, the connection object can be reliably prevented from being detached from the connector. As a result, a state of contact between the contact portion and the connection object can be more stably retained.

DETAILED DESCRIPTION OF THE PREFERRED EMBODIMENT

The connector according to the present invention has a slit-shaped opening in a housing, and a plurality of contact portions provided in the housing are electrically connected to a plate-shaped connection object by inserting the connection object into the opening and putting an actuator into a closed posture. Hereinbelow, the connector according to the present invention will be described with reference to the drawings.

Figure 1A:
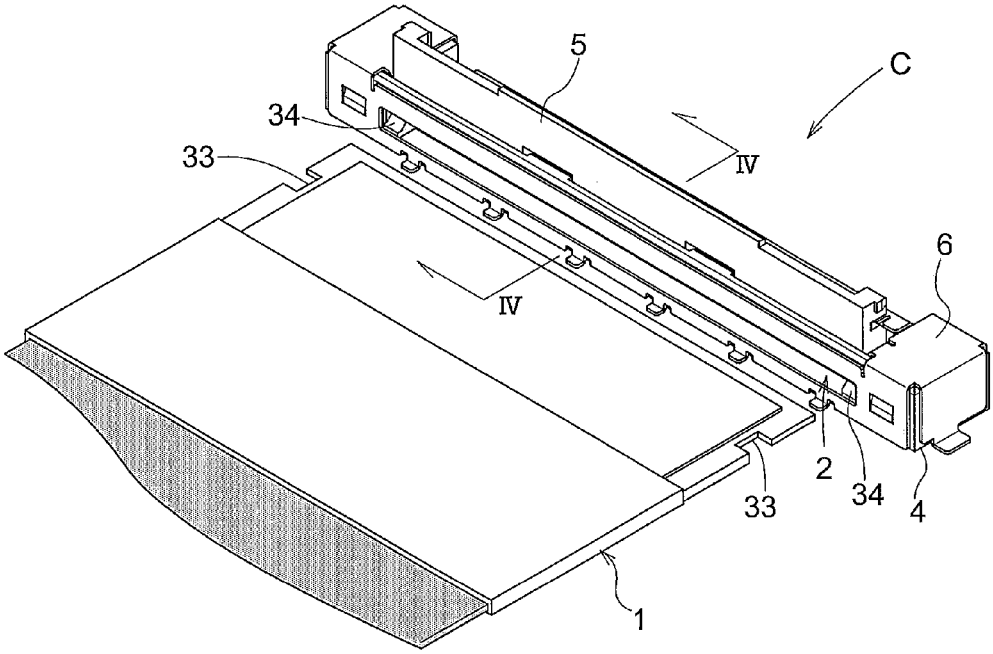
FIG. 1A is a front perspective view showing a connector in a state in which a connection object is not connected thereto.
Figure 1B:
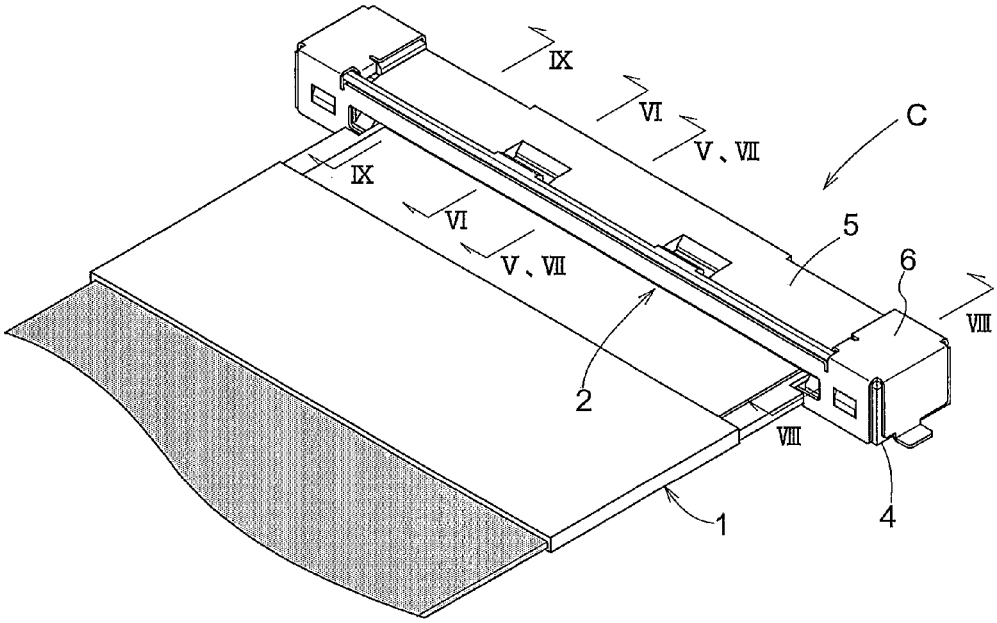
FIG. 1B is a front perspective view showing the connector in a state in which the connection object is connected thereto.
Figure 2A:
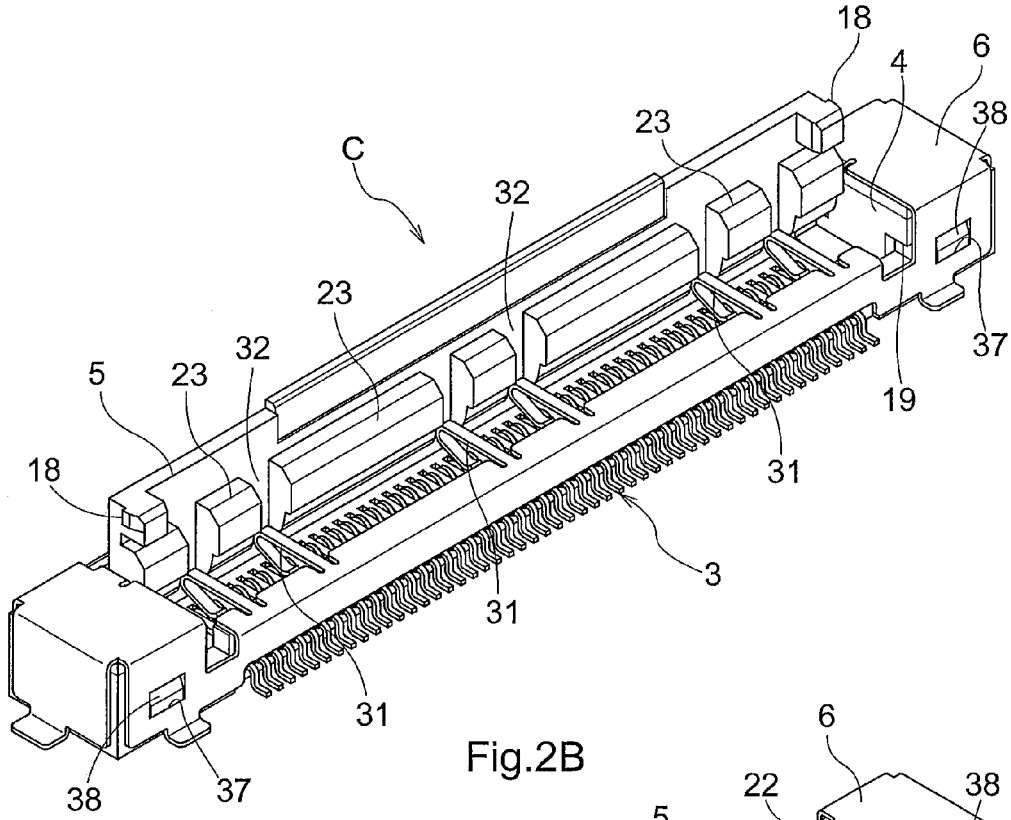
FIG. 2A is a rear perspective view showing a state in which the connection object is not connected thereto.
Figure 2B:
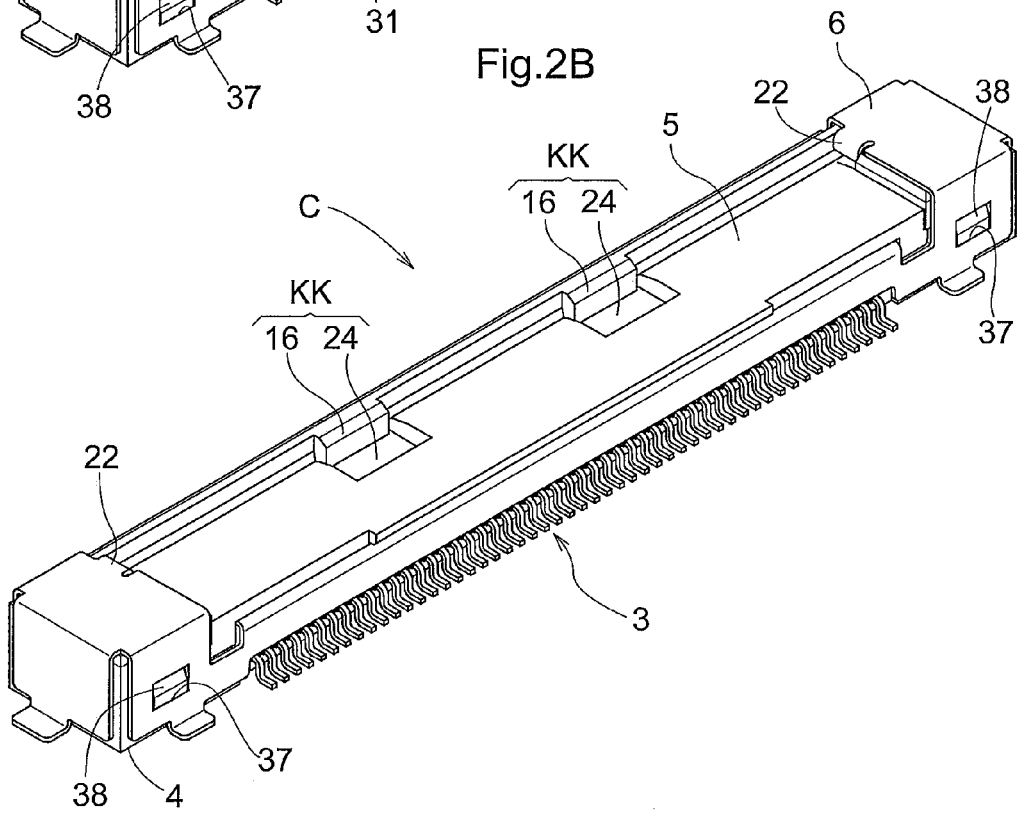
FIG. 2B is a rear perspective view showing the connector in a state in which the connection object is connected thereto.
Figure 3:
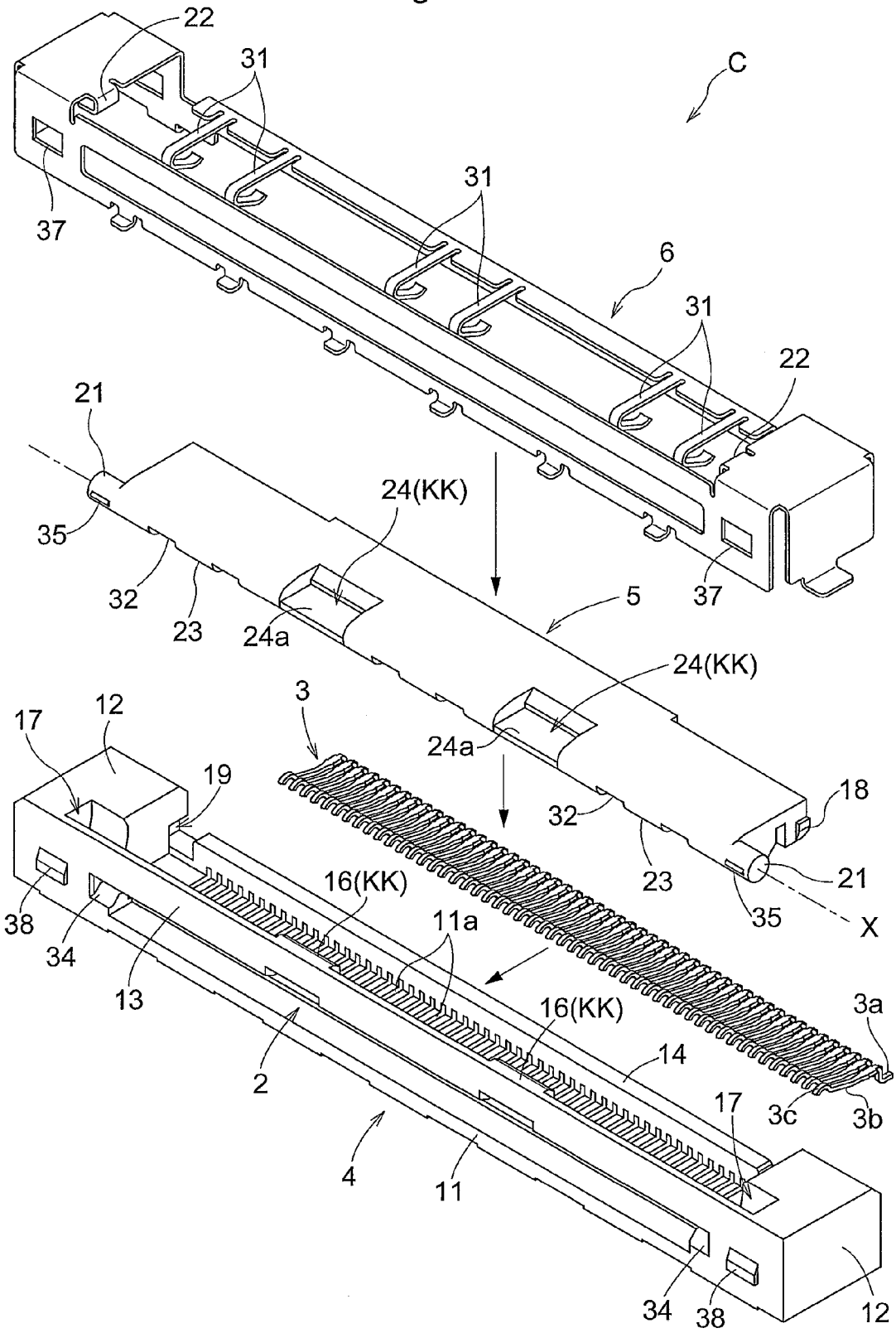
FIG. 3 is an exploded perspective view of the connector.

FIGS. 1A and 1B illustrate a flexible substrate 1 as one example of the connection object before and after connected to a connector C, respectively. FIGS. 2A and 2B are drawings of the connector C of FIGS. 1A and 1B seen from the opposite side, respectively. FIG. 3 is an exploded perspective view of the connector C.

Referring to these drawings, the connector C of the present invention includes: a housing 4 which is made of resin or the like to form a major part of a main body of the connector C; contact portions 3 which is fixed inside the housing 4; an actuator 5 which is made of resin or the like and swingably attached to the housing 4; and a metal cover 6 which covers the housing 4 while preventing the actuator 5 from being detached.

<Housing>

As shown in FIG. 3, the connector C of the present invention includes the housing 4 made of resin or the like. The housing 4 is formed of a bottom wall 11, lateral walls 12, a front wall 13, and a rear wall 14. In a front portion of the housing 4, a slit-shaped opening 2 for inserting the flexible substrate 1 is formed. An upper portion of the housing 4 is opened. This structure is for securing a motion space of the actuator 5, which will be described later. It should be noted that, when the opening in the upper portion is closed by the actuator 5, the actuator 5 serves as an upper wall of the connector C.

<Contact Portion>

As shown in FIG. 3, a plurality of the contact portions 3 are arranged in the bottom wall 11 of the housing 4 in a width direction of the opening 2. The contact portions 3 are accommodated in an accommodating portion 11*a* of the bottom wall 11.

Figure 7:
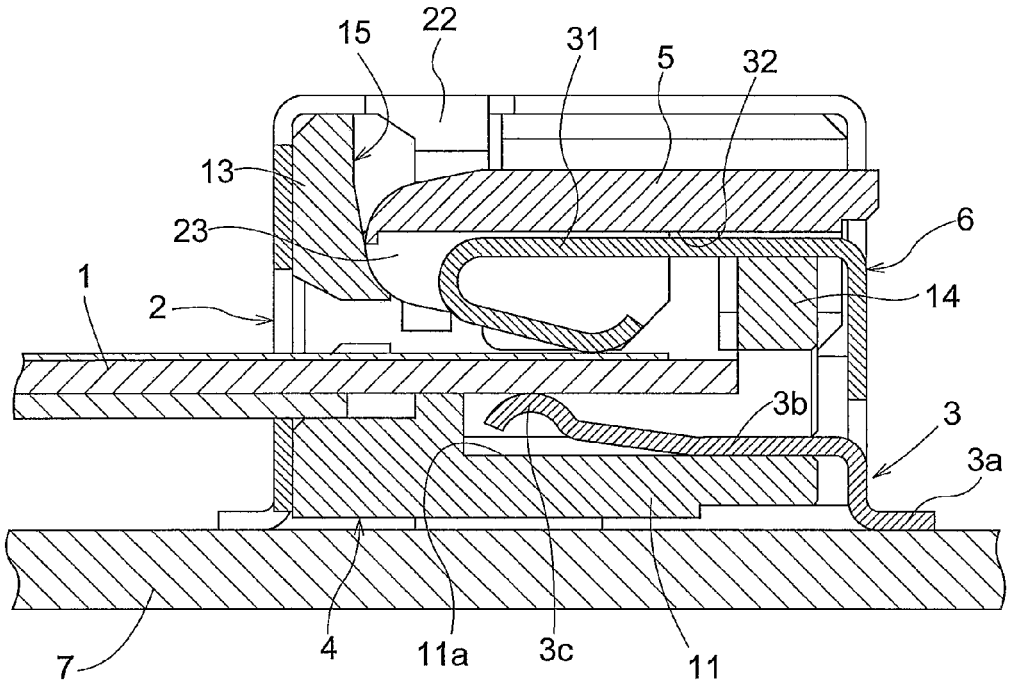
FIG. 7 is a cross-sectional view taken along a line VII-VII in FIG. 1A.

FIG. 7 is a cross-sectional view taken along a line VII-VII in FIG. 1B. As shown in FIG. 7, the contact portion 3 includes: a tail portion 3*a* to be connected to a circuit board 7 to which the housing 4 is fixed; an arm portion 3*b*; and a contact portion 3*c* to be brought into contact with the flexible substrate 1 from a bottom side thereof. Among these, the tail portion 3*a* is soldered to the circuit board 7.

When the flexible substrate 1 is inserted into the opening 2, a leading end of the flexible substrate 1 is brought into contact with the rear wall 14, and a terminal part provided on the flexible substrate 1 and the contact portion 3 are precisely aligned. With this configuration, a plurality of the contact portions 3 are reliably brought into contact with the terminal parts of the flexible substrate 1.

<Actuator>

Figure 8:
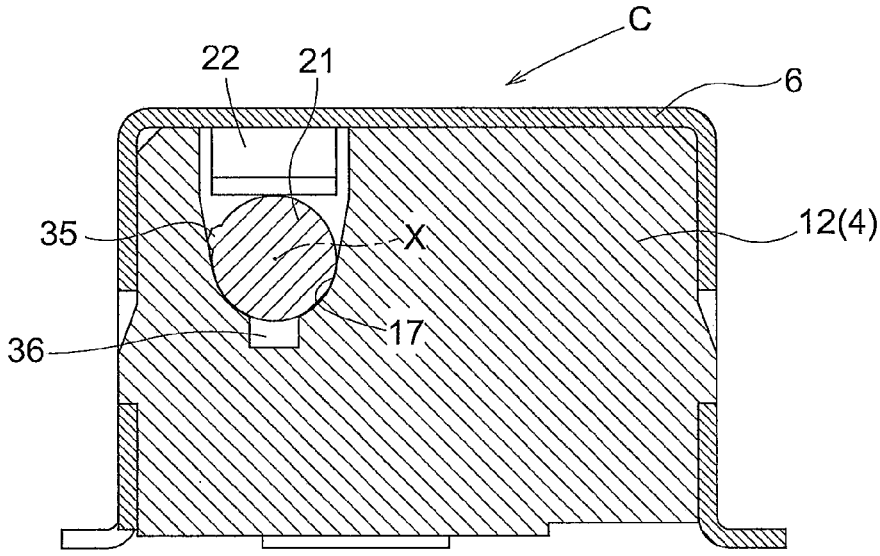
FIG. 8 is a cross-sectional view taken along a line VIII-VIII in FIG. 1B.

FIG. 8 is a cross-sectional view taken along a line VIII-VIII in FIG. 1B. As shown in FIG. 8, the actuator 5 is rotatably supported by the lateral walls 12 of the housing 4. Specifically, in a front portion of each of the lateral walls 12 of the housing 4, a groove 17 (one example of a shaft support) in a shape of an approximate U-shape is formed in a vertical direction when seen from a lateral side. On the other hand, in a front portion of each of lateral end portions of the actuator 5, a rod-shaped shaft 21 is formed which is rotatably supported by the groove 17. With this configuration, the actuator 5 is swingable about an axis X extending in a transversal direction. In the present invention, with respect to the terms used for indicating the directions (such as front, rear, upper and lower) of the components, a side on which the opening 2 is formed is defined as "front". In addition, the directions referring to the actuator 5 mean directions when the actuator 5 is in a closed position.

Figure 4:
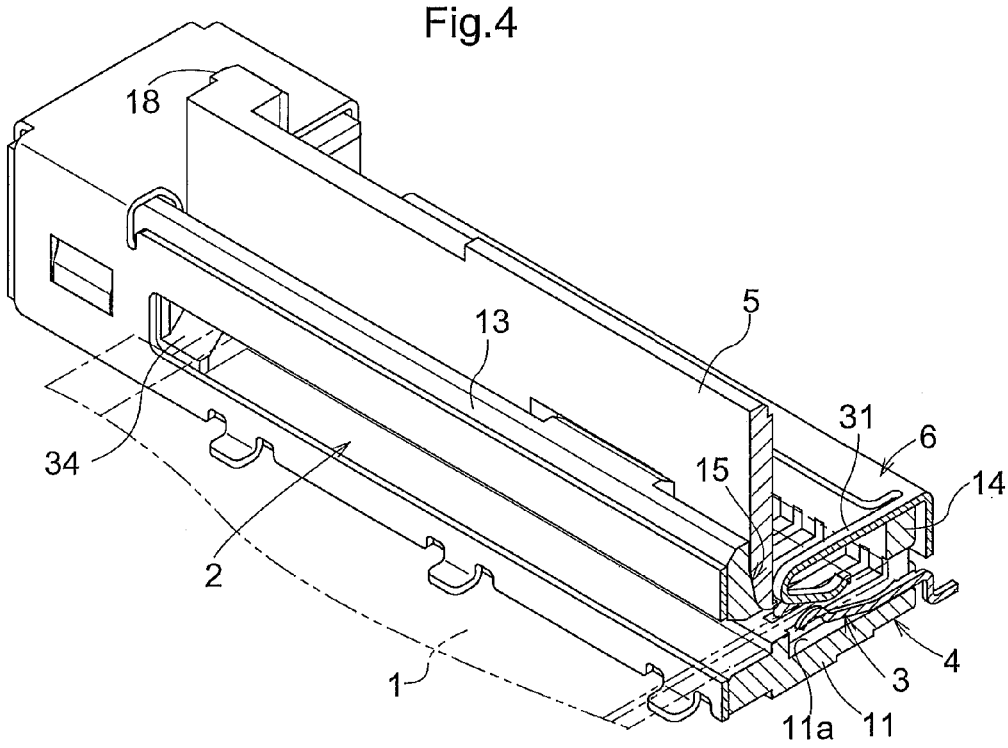
FIG. 4 is a partially cutaway perspective view of the connector.
Figure 5:
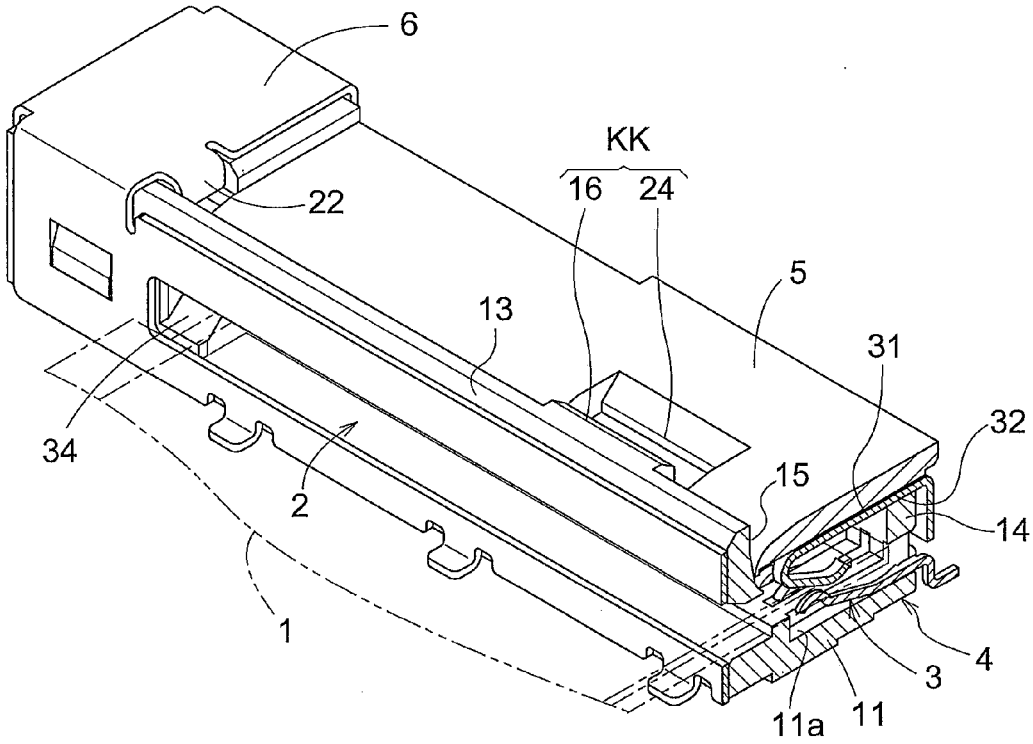
FIG. 5 is a partially cutaway perspective view of the connector.

FIG. 4 is a partially cutaway perspective view of the connector C in which the actuator 5 is in an opened posture and a cutout plane is taken along a line IV-IV in FIG. 1A. On the other hand, FIG. 5 is a partially cutaway perspective view of the connector C in which the actuator 5 is in a closed posture (also referred to as "pressing posture") and a cutout plane is taken along a line V-V in FIG. 1B. As shown in FIGS. 4 and 5, in a rear face of the front wall 13, a rotation restricting portion 15 is formed which comes into contact with an upper face of the actuator 5 when the actuator 5 is rotated to an opening side. The posture of the actuator 5 in this state is defined as upward opened posture. When the actuator 5 is rotated to a closing side, the actuator 5 is brought into contact with the metal cover 6. The posture of the actuator 5 in this state is defined as rearward closed posture.

As shown in FIGS. 2A and 2B, in a rear portion of each of the lateral walls 12 of the housing 4, an engagement groove 19 is formed. On the other hand, in a rear portion of each of both lateral end portions of the actuator 5, an engagement claw 18 is formed which is engageable with the corresponding engagement groove 19. With this configuration, when the actuator 5 is rotated to the closed posture, the engagement claw 18 is engaged with the engagement groove 19 to retain the posture of the actuator 5.

It should be noted that, in the present embodiment, a back flip type is adopted in which a closing direction of the actuator 5 is rearward, and alternatively, a front flip type may be adopted in which the closing direction of the actuator 5 is frontward.

As shown in FIG. 8, the shaft 21 is provided with a projection 35 formed thereon. On the other hand, on a bottom face part of the groove 17, a dent 36 is formed which has a rectangular cross section. When the actuator 5 is in the upward opened posture, the projection 35 is positioned on an inner side relative to both front and rear faces of the dent 36, and at the same time, the shaft 21 is brought into surface contact with the bottom face part of the groove 17. On the contrary, when the actuator 5 is rotated from the opened posture to the closing side, as shown in FIG. 8, the projection 35 is brought into contact with the lateral face of the dent 36, and the rotation of the actuator 5 is paused. With this configuration, the actuator 5 can be retained in the upward opened posture, while the actuator 5 is allowed to swing to some extent.

Figure 6:
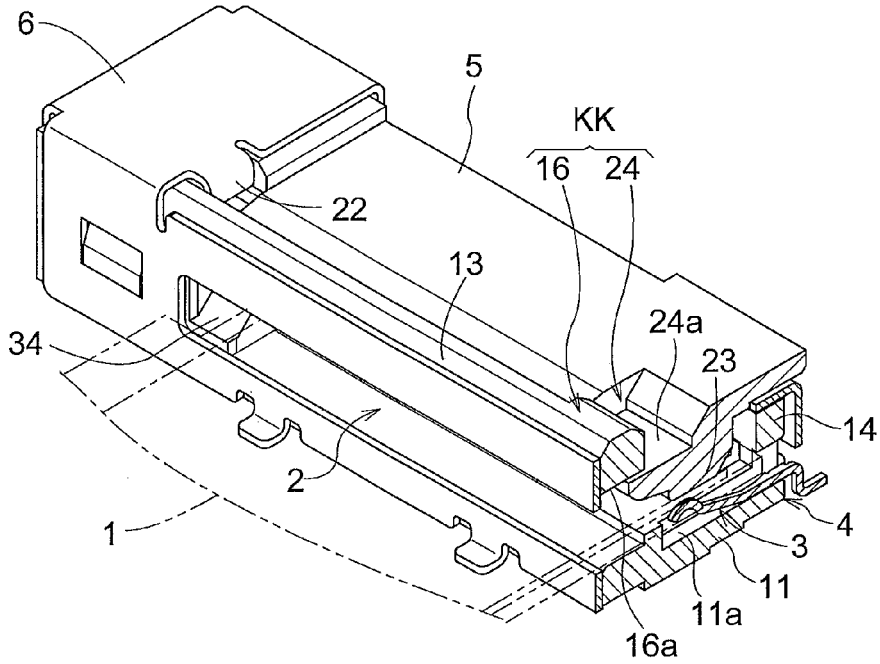
FIG. 6 is a partially cutaway perspective view of the connector.

FIG. 6 is a partially cutaway perspective view of the connector C in which the actuator 5 is in the closed posture and a cutout plane is taken along a line VI-VI in FIG. 1B. As shown in FIGS. 2, 6 and 7, in a front portion of a lower face of the actuator 5, a plurality of pressing portions 23 are formed at predetermined intervals along the width direction of the opening 2, which pressing portions 23 directly press the flexible substrate 1 downward when the actuator 5 is closed. When the flexible substrate 1 is inserted into the opening 2 and the actuator 5 is operated to close, the pressing portions 23 of the actuator 5 press the flexible substrate 1 downward. With this configuration, the flexible substrate 1 is pinched between the actuator 5 and the contact portion 3, and thus is prevented from being risen from the connector C. On the other hand, when the actuator 5 is operated to open, the pressing portions 23 of the actuator 5 are away from the flexible substrate 1. Accordingly, a pinched state of the flexible substrate 1 is canceled and the flexible substrate 1 can be removed from the connector C.

<Restricting Mechanism>

As shown in FIGS. 2-6, a plurality of restricting mechanisms KK are provided in both the housing 4 and the actuator 5 along the width direction of the opening 2, which restricting mechanisms KK prevent the actuator 5 from being deformed upward. The restricting mechanism KK includes: a projection 16 projecting rearward from the rotation restricting portion 15 of the housing 4; and a recess 24 formed in the actuator 5 contiguously from the upper face to a front face of the actuator 5.

As shown in FIG. 6, the projection 16 is in a shape of an approximate rectangular parallelepiped, and has a restricting face 16*a* facing downward. On the other hand, the recess 24 has a restricted face 24*a* which is brought into surface contact with the restricting face 16*a* when the actuator 5 is in the closed posture. In other words, when the actuator 5 is in the closed posture, the recess 24 is fitted onto the projection 16 from below and engaged therewith. With this configuration, even when a deformation force directed upward acts on the actuator 5, the housing 4 as a part of the connector C can prevent the actuator 5 from being deformed in the upward direction. Therefore, when the actuator 5 is in a closed state, rising of the actuator 5 can be reliably prevented. In addition, with respect to the influence of heating by a reflow furnace, attention has to be paid only to a change in relative position between the actuator 5 and the housing 4, and the relative position between the actuator 5 and the housing 4 is more stably retained.

Further, a distance between the upper face of the actuator 5 and the restricted face 24*a* of the recess 24 is set approximately the same as a distance between an upper face of the projection 16 and the restricting face 16*a*, and therefore, when the actuator 5 is in the closed posture, the upper face of the actuator 5 hardly projects from the connector C, which facilitates thinning of the connector C.

It should be noted that the number of the projection 16 and the number of the recess 24 may be one. The restricting face 16*a* may be apart from the restricted face 24*a* when the actuator 5 is in the pressing posture, as long as the rising of the actuator 5 can be prevented with the restricting face 16*a* and the restricted face 24*a* being opposed to each other with a predetermined distance.

<Metal Cover>

As shown in FIGS. 1A, 1B, 2A and 2B, the metal cover 6 is attached to the housing 4. On each of a front side and a rear side of the metal cover 6, engagement holes 37 are formed. On the other hand, on each of a front side and rear side of the lateral wall 12 of the housing 4, engagement claws 38 are formed. With this configuration, when the housing 4 is covered with the metal cover 6, the engagement claws 38 are engaged with the respective engagement holes 37 and the metal cover 6 is fixed to the housing 4.

As shown in FIGS. 3 and 8, the metal cover 6 has stoppers 22 each of which is for preventing the shaft 21 of the actuator 5 from moving and has an approximate U-shape when seen from a front or rear side. With this configuration, during the assembly of the connector C, when the shaft 21 is inserted into the groove 17 and the metal cover 6 is attached, the stopper 22 enters the groove 17 and the shaft 21 is pinched between the stopper 22 and the groove 17. Therefore, the shaft 21 can be prevented from being detached, simply by fitting the shaft 21 into the groove 17 and attaching the metal cover 6.

It should be noted that the stopper 22 may be omitted and the shaft 21 may be pinched between the metal cover 6 and the groove 17.

As shown in FIGS. 2 and 3, the metal cover 6 includes spring portions 31 (one example of pressing portion) arranged at predetermined intervals along the width direction of the opening 2, each of which spring portion 31 is formed by bending downward a part of the metal cover 6 into an approximate J-shape when seen from the lateral side and is configured to press the flexible substrate 1 inserted into the opening 2 when the actuator 5 is in the opened posture. The contact portion 3 is positioned below the spring portion 31, and is configured in such a manner that the flexible substrate 1 is pinched between the spring portion 31 and the contact portion 3.

With this configuration, when the flexible substrate 1 is inserted into the opening 2, even before the actuator 5 is operated to close, the flexible substrate 1 can be temporarily held, and thus when the actuator 5 is operated to close, the flexible substrate 1 will not be pinched at a position displaced from the proper position, or is prevented from being detached from the connector C.

Further, as shown in FIGS. 2A, 2B and 7, when the actuator 5 is in the pressing posture, portions 32 (one example of an auxiliary pressing portion) each of which is formed between the pressing portions 23 of the actuator 5 are brought into contact with the respective spring portions 31 and enhance a pressing force exerted by the spring portions 31. Therefore, a pressing force exerted by the actuator 5 and the pressing force exerted by the spring portions 31 can be set equivalent.

Moreover, the spring portion 31 functions as a shield provided on a nearly whole upper face of the flexible substrate 1, and together with the spring portion 31 and the metal cover 6, can prevent EMI (electromagnetic interference).

It should be noted that the contact portion 3 may not be positioned below the spring portion 31. In this case, the spring portion 31 forces the flexible substrate 1 against the bottom wall 11.

Figure 9:
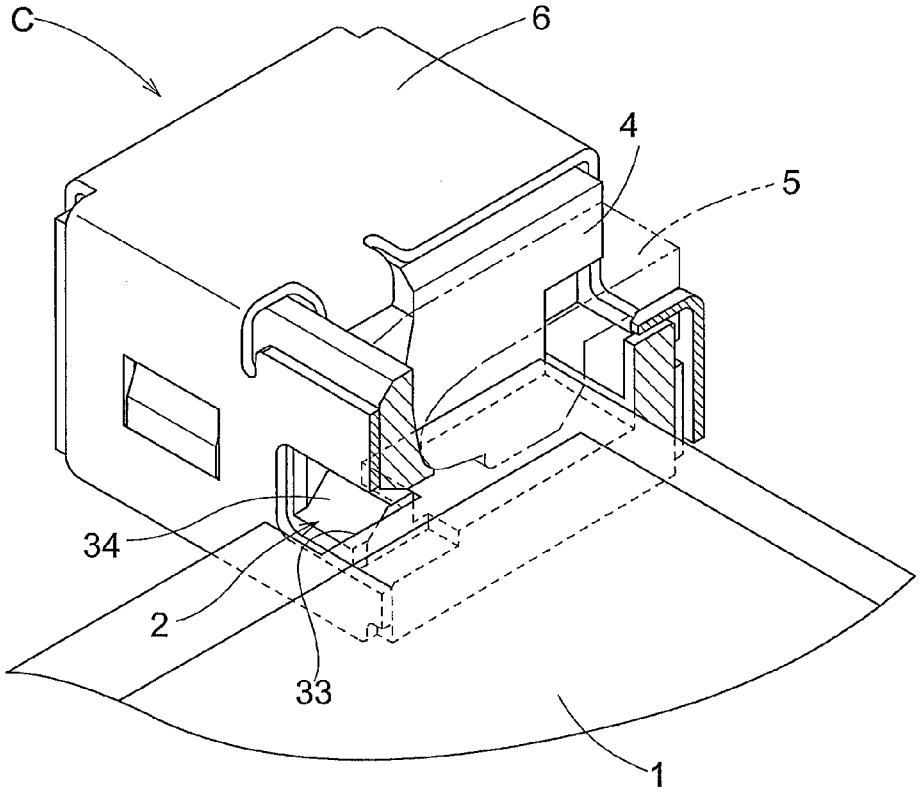
FIG. 9 is a partially cutaway perspective view of the connector.

FIG. 9 is a partially cutaway perspective view showing the connector in which a cutout plane is taken along a line IX-IX in FIG. 1B. As shown in FIG. 9, the flexible substrate 1 has cutouts 33 (one example of absent portion) formed in respective end portions in a width direction of the flexible substrate 1. On the other hand, in the bottom wall 11 of the housing 4, protrusions 34 are formed each of which has an approximately trapezoidal cross section when seen from the lateral side and is engageable with the corresponding cutout 33 when the actuator 5 is in the pressing posture.

It should be noted that the protrusion 34 may be formed contiguously from the lateral walls 12 to the bottom wall 11, as long as the protrusion 34 is provided on a bottom face side in a space in communication with the opening 2. In addition, a hole may be formed instead of the cutout 33.

When the flexible substrate 1 is inserted into the opening 2, the flexible substrate 1 moves upward along inclined faces of the protrusions 34, and the cutouts 33 come to the position above the respective protrusions 34. Since the contact portions 3 support the flexible substrate 1 at this moment, the flexible substrate 1 will not be moved downward. In this condition, when the actuator 5 is operated to close, pressing by the actuator 5 moves the flexible substrate 1 downward, and the protrusions 34 are fitted into the respective cutouts 33. With this configuration, even when a force in a detachment direction acts on the flexible substrate 1, a contact face of the protrusion 34 is engaged with an end face of the corresponding cutout 33, and thus the flexible substrate 1 can be reliably prevented from being detached from the connector C. Conversely, when the actuator 5 is operated to open, the flexible substrate 1 is moved upward by a contact pressure by the contact portions 3, and the protrusion 34 is released from the corresponding cutout 33. Therefore, simply by operating the actuator 5 to open, the engagement between the protrusions 34 and the cutouts 33 can be canceled without lifting the flexible substrate 1.

The present invention can be widely applied to various connectors for connecting a plate-shaped connection object, such as FPC (Flexible Printed Circuit) and FFC (Flat Flex Cables).

The invention claimed is:

1. A connector comprising:

a contact portion electrically connectable to a plate-shaped connection object;

a housing having a slit-shaped opening into which the connection object is insertable, the housing accommodating the contact portion;

an actuator which is supported on the housing swingably between an opened posture and a pressing posture about an axis extending in a width direction of the opening, and configured to directly press the connection object when the actuator is in the pressing posture; and a restricting mechanism which is provided along the width direction of the opening, formed in both the housing and the actuator, and configured to prevent the actuator from being deformed in a direction opposite to a pressing direction of the actuator when the actuator is in a pressing posture of pressing the connection object, wherein the actuator has an axis and a shaft that protrudes from lateral end portions of the actuator, wherein the housing has lateral walls, each of which is provided with an approximately U-shaped shaft support for rotatably supporting the corresponding shaft so as to restrict a sliding movement of the connection object along an insertion direction while allowing a rotational movement of the shaft, wherein the restricting mechanism comprises a projection which projects from the housing and has a restricting face facing downward, and a recess which is formed in the actuator contiguously from an upper face to a front face of the actuator and has a restricted face configured to be brought into surface contact with the restricting face when the actuator is in the pressing posture, and wherein the restricted face is provided on the axis in a planar view in which the actuator is in the pressing posture.

2. The connector according to claim 1, further comprising:

a metal cover for covering the housing, wherein the metal cover comprises a pressing portion for pressing the inserted connection object when the actuator is in the opened posture.

3. The connector according to claim 2, wherein the pressing portion is formed of a part of the metal cover, which part is bent in the pressing direction.

4. The connector according to claim 2, wherein the actuator comprises an auxiliary pressing portion for enhancing a pressing force exerted by the pressing portion, by coming into contact with the pressing portion when the actuator is in the pressing posture.

5. The connector according to claim 2, wherein the metal cover is configured to cover an opening part of the shaft support.

6. The connector according to claim 1, wherein the connection object has lateral end portions in a width direction thereof, each of which lateral end portion is provided with an absent portion formed therein, and the housing is provided with a protrusion formed on a bottom side of a space in communication with the opening, the protrusion being engageable with the absent portion when the actuator is in the pressing posture.

* * * * *